US007832179B2

(12) United States Patent
Ou

(10) Patent No.: US 7,832,179 B2
(45) Date of Patent: Nov. 16, 2010

(54) I JOIST

(75) Inventor: Nianhua Ou, Dacula, GA (US)

(73) Assignee: Huber Engineered Woods LLC, Charlotte, NC (US)

( * ) Notice: Subject to any disclaimer, the term of this patent is extended or adjusted under 35 U.S.C. 154(b) by 316 days.

(21) Appl. No.: 11/312,942

(22) Filed: Dec. 20, 2005

(65) Prior Publication Data

US 2007/0151198 A1 Jul. 5, 2007

(51) Int. Cl.
*E04C 3/00* (2006.01)

(52) U.S. Cl. ..... 52/837; 52/839

(58) Field of Classification Search ..... 52/729.1–729.4, 52/837–840

See application file for complete search history.

(56) References Cited

U.S. PATENT DOCUMENTS

| | | | | | |
|---|---|---|---|---|---|
| 323,424 | A | | 8/1885 | Jackson | |
| 1,377,891 | A | | 5/1921 | Knight | |
| 3,490,188 | A | | 1/1970 | Troutner | |
| 3,960,637 | A | | 6/1976 | Ostrow | |
| 4,144,690 | A | | 3/1979 | Avery | |
| 4,191,000 | A | | 3/1980 | Henderson | |
| 4,195,462 | A | * | 4/1980 | Keller et al. | 52/690 |
| 4,285,374 | A | | 8/1981 | Klingel | |
| 4,356,045 | A | | 10/1982 | Elford et al. | |
| 4,362,589 | A | | 12/1982 | Smith et al. | |
| 4,456,497 | A | | 6/1984 | Eberle | |
| 4,584,809 | A | | 4/1986 | Stanford | |
| 4,637,194 | A | | 1/1987 | Knowles | |
| 4,638,619 | A | | 1/1987 | Fischetti | |
| 4,683,631 | A | | 8/1987 | Dobbertin | |
| 4,720,318 | A | | 1/1988 | Lines | |
| 4,840,207 | A | | 6/1989 | Lines | |
| 4,967,534 | A | | 11/1990 | Lines | |
| 4,971,355 | A | | 11/1990 | Studdard | |
| 5,060,443 | A | | 10/1991 | Pacione | |
| 5,079,894 | A | | 1/1992 | Lau | |
| 5,144,786 | A | | 9/1992 | Pacione | |
| 5,267,425 | A | | 12/1993 | Onysko et al. | |
| 5,323,584 | A | | 6/1994 | Scarlett | |
| 5,443,894 | A | * | 8/1995 | Pollock et al. | 428/213 |
| 5,648,138 | A | | 7/1997 | Tingley | |
| 5,652,065 | A | | 7/1997 | Park et al. | |

(Continued)

OTHER PUBLICATIONS

ILevel TimberStand® Laminated Strand Lumber, For Quality Door and Window Components; 2001-2010; pp. 1-2; Weyerhaeuser NR Company; http://www.weyerhaeuser.com/Businesses/WoodProducts/TimberStrand.

(Continued)

*Primary Examiner*—David Dunn
*Assistant Examiner*—Daniel Kenny
(74) *Attorney, Agent, or Firm*—Gardner Groff Greenwald & Villanueva, P.C.

(57) ABSTRACT

Disclosed is an I joist comprising: a top flange made from a wood composite material selected from the group comprising oriented strand lumber and oriented strand board; a bottom flange composed of laminated veneer lumber or dimension lumber; and a webstock member, made from a wood composite material selected from the group comprising oriented strand lumber and oriented strand board, which interconnects the top flange and the bottom flange.

5 Claims, 1 Drawing Sheet

U.S. PATENT DOCUMENTS

| | | | | |
|---|---|---|---|---|
| 5,802,800 | A | 9/1998 | Meyers | |
| 5,867,963 | A | 2/1999 | Hershey | |
| 5,885,685 | A | 3/1999 | Tingley | |
| 5,910,352 | A | 6/1999 | Tingley | |
| 5,974,760 | A | 11/1999 | Tingley | |
| 6,001,452 | A | 12/1999 | Bassett et al. | |
| 6,012,262 | A | 1/2000 | Irving | |
| 6,173,550 | B1 | 1/2001 | Tingley | |
| 6,212,846 | B1 | 4/2001 | Johnston | |
| 6,224,704 | B1 | 5/2001 | Bassett et al. | |
| 6,245,842 | B1 | 6/2001 | Buxton et al. | |
| 6,460,310 | B1 | 10/2002 | Ford et al. | |
| 6,497,080 | B1 * | 12/2002 | Malcolm | 52/731.7 |
| 6,565,959 | B1 | 5/2003 | Tingley | |
| 6,684,596 | B2 | 2/2004 | Rastegar | |
| 7,124,544 | B2 * | 10/2006 | Brown et al. | 52/264 |
| 2003/0041551 | A1 * | 3/2003 | Boone et al. | 52/698 |
| 2003/0159396 | A1 * | 8/2003 | Brown et al. | 52/729.1 |

OTHER PUBLICATIONS

Material Safety Data Sheet, TimberStrand LSL, TJO Joist, iLevel Shear Brace; May 21, 2008; pp. 1-7; Weyerhaeuser; http://www.weyerhaeuser.com/pdfs/msds/313.pdf.

ICC-ES Evaluation Report, ESR-1387; ES ICC Evaluation Service; May 1, 2009; pp. 1-21; Weyerhaeuser; http://www.icc-es.org/reports/pdf_files/ICC-ES/ESR-1387.pdf.

TimberStrand® LSL Wall Framing; 2009; p. 1; Weyerhaeuser Company; http://www.ilevel.com/walls/w_TimberStrandLSL_studs.aspx.

TimberStrand® LSL; iLevel Trus Joist TimberStrand® LSL; 2009; p. 1; Weyerhaeuser Company; http://www.ilevel.com/aboutilevel/technologies/TimberStrandLSL.aspx.

U.S. Wall Guide, Featuring Trus Joist® TimberStrand® LSL and Parallam® PSL Wall Framing; iLevel; Mar. 2010; pp. 1-16; #TJ-9003; Weyerhaeuser.

Trus Joist® 18" and 20" TJI® 360 TJI® 560 Joists, Featuring Silent Floor® Joists for Residential Applications; iLevel; May 2008; pp. 1-12; #TJ-4005; Weyerhaeuser.

The Best Just Got Better. Introducting Our Upgraded TJI® Joists.; iLevel; Jan. 2009; pp. 1-2; SR-104; Weyerhaeuser.

* cited by examiner

I JOIST

BACKGROUND OF THE INVENTION

A structural, weight-bearing floor system is constructed by laying a floor deck across a number of underlying, supporting I joists. The deck may be made of a variety of different materials, with wood being particularly preferred in residential home construction.

Suitably strong and stiff wood joists are typically in the form of an "I joist." An I joist has three parts: two flange members with an interconnecting webstock member. The I joist is constructed by creating a groove in each of the flange members into which the webstock member is inserted. In many applications, particularly for large scale commercial construction the I beams will be made from forged steel. However, in less-demanding applications such as the construction of residential and home construction, wood is often used because it costs less, is more easily cut, and doesn't require special fasteners can be easily adapted for use in residential and small-scale commercial buildings. While at one time all of these pieces were formed from solid wood lumber, recently they are more likely to be made from an alternative to solid wood lumber, engineered wood composites, because of both the cost of high-grade timber wood as well as a heightened emphasis on conserving natural resources. Plywood, particle board, laminated veneer lumber ("LVL"), oriented strand lumber ("OSL"), and oriented strand board ("OSB") are examples of wood-based composite alternatives to natural solid wood lumber that have replaced natural solid wood lumber in many structural applications in the last seventy-five years. These engineered wood composites not only use the available supply of timber wood more efficiently, but they can also be formed from lower-grade wood species, and even from wood wastes.

However, in order to maximize the load that a composite wood I joist can carry, it is necessary to construct the I joist to match the somewhat complicated stress profile that an I joist experiences when a downward load is applied. In these circumstances, the stresses generated are distributed as compression along a top flange and as tension in the bottom flange.

Accordingly, there is a need in the art for an I joist that is constructed so that the top flange is composed of a wood composite material that is excellent at sustaining a compression load while the bottom flange is composed of a wood composite material that is excellent at sustaining a tension load.

BRIEF SUMMARY OF THE INVENTION

The present invention relates to an I joist comprising: a top flange made from a wood composite material selected from the group comprising oriented strand lumber and oriented strand board; a bottom flange composed of laminated veneer lumber or dimension lumber; and a webstock member, made from a wood composite material selected from the group comprising oriented strand lumber and oriented strand board, which interconnects the top flange and the bottom flange.

BRIEF DESCRIPTION OF THE DRAWINGS

The accompanying drawings, which are incorporated in and constitute a part of this specification, illustrate several aspects described below. Like numbers represent the same elements throughout the figures.

DETAILED DESCRIPTION OF THE INVENTION

Figure 1:
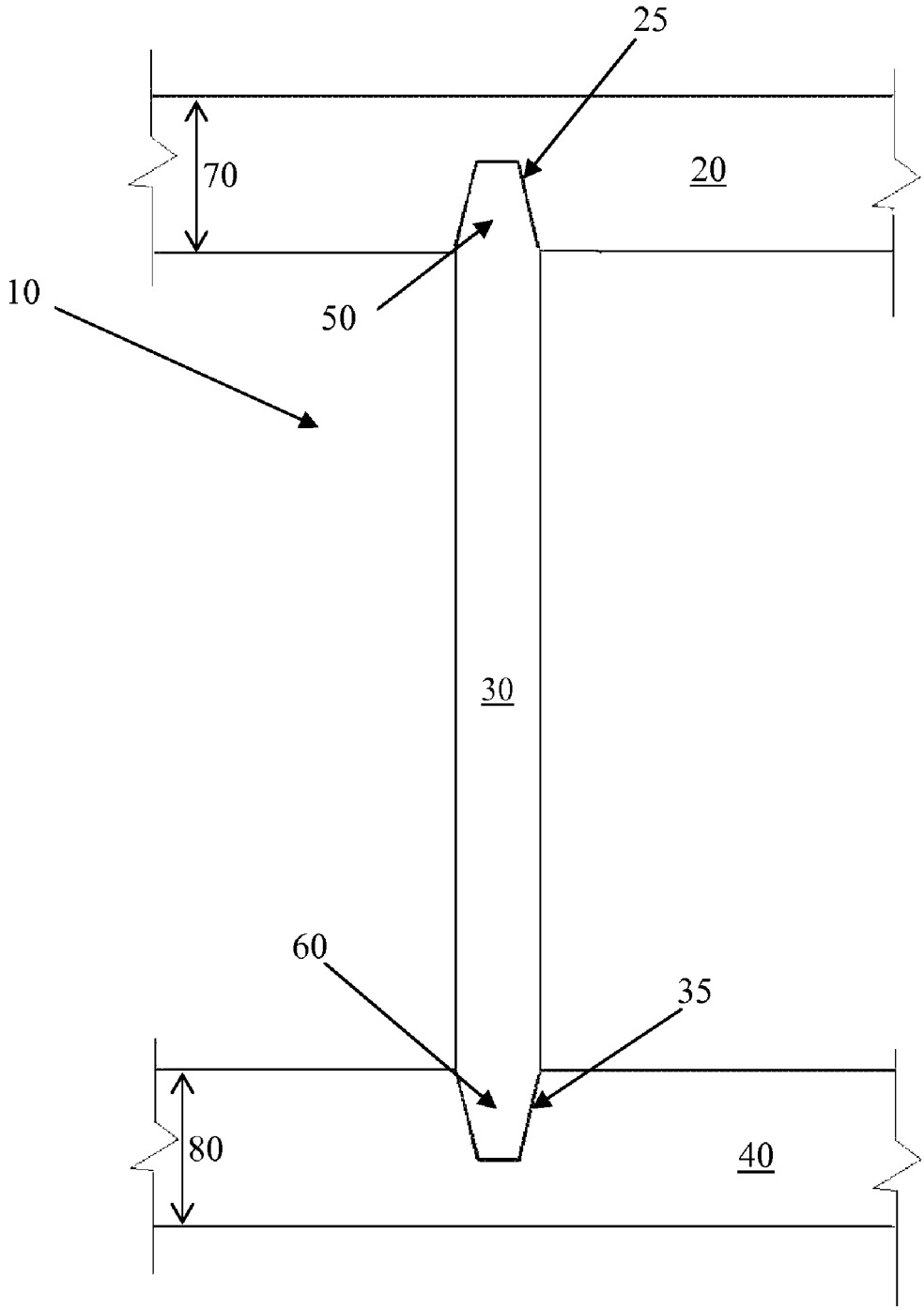
FIG. 1 illustrates a cross-section of an example embodiment of an I joist according to the present invention.

All parts, percentages and ratios used herein are expressed by weight unless otherwise specified. All documents cited herein are incorporated by reference.

As used herein, "wood" is intended to mean a cellular structure, having cell walls composed of cellulose and hemicellulose fibers bonded together by lignin polymer.

By "laminated", it is meant material composed of layers and bonded together using resin binders.

By "wood composite material" or "wood composite component" it is meant a composite material that comprises wood and one or more other additives, such as adhesives or waxes. Non-limiting examples of wood composite materials include oriented strand board ("OSB"), laminated veneer lumber (LVL), oriented strand lumber (OSL), structural composite lumber ("SCL"), waferboard, particle board, chipboard, medium-density fiberboard, plywood, and boards that are a composite of strands and ply veneers. As used herein, "flakes", "strands", and "wafers" are considered equivalent to one another and are used interchangeably. A non-exclusive description of wood composite materials may be found in the Supplement Volume to the Kirk-Othmer Encyclopedia of Chemical Technology, pp 765-810, $6^{th}$ Edition, which is hereby incorporated by reference.

In residential construction a floor is typically is built upon a conventional foundation (for the first story), which supports a floor comprised of a series of parallel, spaced apart floor I joists, with a wood decking fastened upon them. The I joists, commonly made of wood, consist typically of three sections: two flange members that are interconnected by a webstock member. While in most I joists the flange members are interchangeable, and the I joists display $C_2$ symmetry, in the I joists of the present invention the flanges are not interchangeable, but instead have distinct "top" and "bottom" flange members, as will be discussed in greater detail below.

Typically, the cross-sections of the flange are rectangular and have a pair of wider (or major) faces of between three inches to four inches, and a dimension along the other pair of faces (or minor faces) of between one inch to 2 inches. (Common cross section dimensions are 2"×3" and 2"×4"). Formed along each of the major faces is a groove that has a complementary shape to the tongues extending from the opposing ends of the webstock member. Thus, when fitted together, joints are formed between the opposing ends of the webstock member and grooves located in the wider face of each flange piece to receive the webstock. Typically, these joints will be glued together with an adhesive resin to hold the I joist together by applying glue to the tongues extending from the opposing ends of the webstock member. The interlocking tongue and groove surfaces ensure good, tight fits with adjacent I joist members. The I joists may then be placed in clamps until the adhesive in the joint is set.

In the present invention, improved strength performance in an I joist 10 is obtained by specially selecting specific wood materials, based on their specific strength characteristics, for a specific place in the I joist construction. Thus, because OSB and OSL both have excellent performance under compressions load, in the I joist 10 of the present invention, they are selected as the top flange material, since the top flange 20 experiences mainly compression loading.

(Yet another reason for selecting OSB or OSL for the top flange is their excellent nail withdrawal and nail split-resistance performance. These properties are important because the top flange receives the fasteners that connect the floor deck panels to the underlying I joist, and these properties measure the maximum strength with which such connection may be made. The "nail withdrawal" strength is the amount of force required to pull a nail out of the top flange, while the "split-resistance" measures how well the top flange resists splitting when a nail or screw is inserted into it.)

Similarly, because LVL and dimensional lumber have excellent performance for bending loads and high tensile strength, they are ideal materials to use in the bottom flange 40 which is placed in tension. When constructed in this fashion, the width of the top 20 and bottom 40 flanges gives such stiffness to the I joist 10 that a thinner webstock material may be used to interconnect the flanges 20, 40 compared to prior art I joists.

In an alternative aspect of the present invention, the top flange 20 has a first cross section 70 and the bottom flange 40 has a second cross section 80, each of which are different. A wider top flange 20 is preferable because it has better nail holding performance, better split resistance, better glue bonding strength and higher edgewise stiffness. The increased size of the top flange cross section 70 does not entail significant additional cost, because the material for the top flange 20 (e.g., OSB, or OSL) cost much less than traditional flange materials and costs less than the material for the bottom flange 40 too.

The I joists 10 of the present invention are constructed in the following manner.

As has been mentioned above, oriented strand board ("OSB") may be used for both the top flange 20 and webstock 30. Given that the top flange 20 of the material and the webstock 30 are placed in compression when under load, the strength performance of the I joist 10 is likely to be enhanced by the use of a material like OSB that performs well (or even superior to commonly used flange materials like solid wood lumber) under compression. Processes for making OSB are well-known to those skilled in the art.

A suitable thickness range for the OSL or OSB top flange material is in the range of from about 1" to about 2", preferably about 1.5".

Typical OSB thicknesses include ⅜" and 7/16", or ½" can be used for the webstock. Preferably, the webstock portion 30 is ⅜ inch thick Advantech® OSB available from Huber Engineered Woods, Charlotte, N.C., having a density of from about 44 to about 48 pcf. Resins or binders used include those typical for OSB; phenolic (PF) and pMDI are most common. Resin loading will vary depending on desired performance; loading should be at least 2% of either of the above binders. pMDI is preferred for line speed and weatherability performance. Wax can be included as a water repellent at a 0.2%-2.0% loading level. All levels are expressed as a percent of oven dry wood. The adhesive resin used in the present invention may be selected from a variety of different polymer materials such as epoxies, phenolic, resorcinol, acrylic, urethane, phenolic-resorcinol-formaldehyde resin, and polymeric methylenediisocyanate ("pMDI"). The selection will largely depend on the cost and performance targets specified.

Some examples of specific resin systems that are suitable for use in the present invention include ISOSET® UX-100 Adhesive, available from Ashland Specialty Chemical Company, Columbus, Ohio. ISOSET is a two-part resin system, based on a 100-percent solids polyurethane adhesive, blended with conventional ISOSET adhesive. This system offers faster strength and faster complete cure times, while providing excellent strength performance. Also suitable is the two-part adhesive system from Borden Chemical Company, Columbus, Ohio, containing phenolic-resorcinol-formaldehyde resin, PRF 5210J and FM7340, a formaldehyde activator necessary to harden the resin at room temperature. Also suitable is Huntsman 1075 polyurethane adhesives for I joists available from Huntsman, Salt Lake City, Utah.

Oriented Strand Lumber ("OSL") is similar to OSB, but differs in that OSL generally uses longer strands, that are aligned mostly in the parallel direction, and also makes use of a special manufacturing process using steam-injection pressing that creates a uniform density profile throughout the thickness of the product. Laminated veneer lumber ("LVL") has long been a preferred engineered wood composite for flange materials because of its strength and uniform properties.

In one specific embodiment, the I joist 10 comprises a top flange 20 made from a wood composite material selected from the group consisting of oriented strand lumber and oriented strand board, with a top flange groove 25 formed in the top flange 20; a bottom flange 40 composed of laminated veneer lumber, with a bottom flange groove 35 formed in the bottom flange 40; and a webstock member 30, which interconnects the top flange 20 and the bottom flange 40, having a first tongue profile 50 and a second tongue profile 60 formed on opposing ends of the webstock member 30, the webstock made from a wood composite material selected from the group consisting of oriented strand lumber and oriented strand board; wherein the first tongue profile 50 and the second tongue profile 60 are shaped complementary to the top flange groove 25 and bottom flange groove 35, respectively.

The invention will now be described in more detail with respect to the following, specific, non-limiting examples.

Example 1

As mentioned above, an important part of the present invention is the nail withdrawal strength and split-resistance performance. To compare the relative performance of different materials such as OSB, solid wood lumber, and LVL in this regard measurements were made in accordance with ASTM Test Standards D1037-99 "Standard Test Methods for Evaluating Properties of Wood-Base Fiber and Particle Panel Materials" with the results shown in Table 1, and in accordance with National Wood Window and Door Association Test Standard NWWDA TM-5 "Split Resistance Test", with the results shown in Table 2.

TABLE 1

| Nail Withdrawal | | |
|---|---|---|
| Sample | Nominal Load (lbs/in) | Density (lbs/ft$^3$) |
| Lumber | 118.9 | 27.2 |
| LVL | 203.2 | 42.2 |
| OSB | 193.7 | 46.6 |

TABLE 2

| Split Resistance | | |
|---|---|---|
| Sample | Peak Load (lbs) | Density (lbs/ft$^3$) |
| Lumber | 632.5 | 30.1 |
| LVL | 63.0 | 43.0 |
| OSB | >2000 | 43.0 |

In each case, ten samples were tested.

As can be seen in Table 1, solid wood lumber had a significantly lower nominal load value for nail withdrawal than the wood composite materials LVL and OSB.

As can be seen in Table 2, OSB had a significantly higher split resistance than LVL or solid wood lumber—in fact just how much higher is not known because at the 2000 lbs peak testing load, the OSB samples had still not failed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An I joist for supporting floor deck panels, comprising:

a top flange made from a wood composite material selected from the group consisting of oriented strand lumber and oriented strand board;

a bottom flange composed of laminated veneer lumber or dimension lumber; and a webstock member, made from a wood composite material selected from the group consisting of oriented strand lumber and oriented strand board, which interconnects the top flange and the bottom flange, wherein the top flange is wider than the bottom flange, and wherein the I-joist is operably oriented with the top flange positioned above the bottom flange and wherein the top flange is adapted to receive the floor deck panels thereon.

2. An I joist comprising:

a top flange made from a wood composite material selected from the group consisting of oriented strand lumber and oriented strand board, with a top flange groove formed in the top flange;

a bottom flange composed of laminated veneer lumber or dimension lumber, with a bottom flange groove formed in the bottom flange; and a webstock member, which interconnects the top flange and the bottom flange, having a first tongue profile and a second tongue profile formed on opposing ends of the webstock member, the webstock made from a wood composite material selected from the group consisting of oriented strand lumber and oriented strand board;

wherein the first tongue profile and the second tongue profile are shaped complementary to the top flange groove and bottom flange groove, respectively, and wherein the top flange is wider than the bottom flange.

3. An I joist comprising:

a top flange made from a wood composite material selected from the group consisting of oriented strand lumber and oriented strand board, with a first tapered groove formed in the top flange;

a bottom flange composed of laminated veneer lumber or dimension lumber, with a second tapered groove formed in the bottom flange, the bottom flange being narrower than the top flange; and a webstock member, made from a wood composite material selected from the group consisting of oriented strand lumber and oriented strand board, which interconnects the top flange and the bottom flange;

wherein the webstock member includes a first tapered tongue and a second tapered tongue formed on opposing ends of the webstock member; and wherein the first tapered tongue and the second tapered tongue are complementary shaped to engage the first tapered groove and the second tapered groove, respectively.

4. The I joist according to claim 3, wherein the top flange is made from oriented strand board, and the webstock is made from oriented strand board.

5. The I joist according to claim 3, wherein the top flange is made from oriented strand lumber, and the webstock is made from oriented strand lumber.

* * * * *